US008235052B2

(12) United States Patent
Maurello

(10) Patent No.: US 8,235,052 B2
(45) Date of Patent: Aug. 7, 2012

(54) MOUTHGUARD

(76) Inventor: John Maurello, Oceanside, NY (US)

( * ) Notice: Subject to any disclaimer, the term of this patent is extended or adjusted under 35 U.S.C. 154(b) by 538 days.

(21) Appl. No.: 11/325,261

(22) Filed: Jan. 5, 2006

(65) Prior Publication Data

US 2007/0151568 A1 Jul. 5, 2007

(51) Int. Cl.
*A61C 5/14* (2006.01)

(52) U.S. Cl. ..... 128/859; 128/861

(58) Field of Classification Search ..... 128/859, 128/861; 433/6, 34, 93, 176, 217.1
See application file for complete search history.

(56) References Cited

U.S. PATENT DOCUMENTS 3,319,626 A * 5/1967 Lindsay ..... 128/861
4,526,540 A * 7/1985 Dellinger ..... 433/24
4,554,154 A * 11/1985 White ..... 424/435
4,568,280 A * 2/1986 Ahlin ..... 433/6
4,664,109 A * 5/1987 Rasocha ..... 128/207.14
4,949,731 A * 8/1990 Harding ..... 128/842
4,977,905 A * 12/1990 Kittelsen et al. ..... 128/861
5,071,349 A * 12/1991 Skinner ..... 433/136
5,163,840 A * 11/1992 Bourke ..... 433/6
5,536,168 A * 7/1996 Bourke ..... 433/6
5,620,011 A * 4/1997 Flowers ..... 128/859
5,638,810 A * 6/1997 Yavitz ..... 128/205.27
5,711,254 A * 1/1998 O'Rourke ..... 119/710
5,970,981 A * 10/1999 Ochel ..... 128/859
6,244,269 B1 * 6/2001 Tyler ..... 128/859
6,247,930 B1 * 6/2001 Chiang et al. ..... 433/80
6,935,857 B1 * 8/2005 Farrell ..... 433/6
7,328,706 B2 * 2/2008 Bardach et al. ..... 128/861
2004/0149292 A1 * 8/2004 Fujieda et al. ..... 128/861
2006/0084024 A1 * 4/2006 Farrell ..... 433/6
2007/0151567 A1 * 7/2007 Maurello ..... 128/859

* cited by examiner

*Primary Examiner* — Patricia Bianco
*Assistant Examiner* — Camtu Nguyen
(74) *Attorney, Agent, or Firm* — Leo G. Lenna

(57) ABSTRACT

The present application is directed to a mouth guard to protect the user's teeth and/or jaw. It is important that the mouth guard fit tightly and properly in order to fully protect the user. The present invention achieves the proper fit by having cilia in the cavity that comes in contact with the user's teeth. These cilia move to allow the mouth guard to fit tightly and properly. In addition, the mouth guard of the present invention may contain flavoring such as Gatorade, bubble gum flavoring, as well as the traditional cherry, orange and grape that can be released into the oral cavity of the user while wearing the mouth guard. This allows the user to taste the flavoring while using the mouth guard.

9 Claims, 5 Drawing Sheets

MOUTHGUARD

FIELD OF THE INVENTION

The present invention relates to a mouth guard for use by an athlete while participating in contact sports such as football, hockey, and lacrosse, which may be used alone or in combination with a protective helmet or protective headgear. In particular, the present invention relates to a mouth guard having raised cilia in the cavity designed to accept the teeth that can be manipulated by the teeth once worn to make the mouth guard fit properly. In addition, the present invention relates to a mouth guard having a flavor impregnated within either as flavor crystals or as a separate flavor pouch so as to allow the user to taste a particular flavor when released.

BACKGROUND OF THE INVENTION

Participation in athletic activities is increasing at all age levels. All participants may be potentially exposed to physical harm as a result such participation. Physical harm is more likely to occur in athletic events were collisions between participants frequently occurs such as football, field hockey, lacrosse, ice hockey, soccer and the like. In connection with sports such as football, hockey and lacrosse where deliberate collisions between participants are common, the potential for physical harm and/or injury is greatly enhanced. Facial trauma experienced by athletes has been demonstrably reduced by the use of a mouth guard during participation in athletic events. These mouth guards, or mouth protectors, provide protection against injuries to the teeth, lips, cheeks, and gums, and may also reduce the incidence of head and neck injuries, concussions, and jaw fractures.

The use of mouth guards is well known. In fact the American Society for Testing and Materials has classified mouth guards into three types: stock mouth guards, mouth-formed mouth guards, and custom-fabricated mouth guards. Some of these mouth guards are fitted with a tether or strap to connect them to a fastening point, such as a helmet or the like, to prevent loss, swallowing or choking on the mouth guard by the user.

Stock mouth guards typically can be purchased at sporting goods stores, department stores and/or pharmacies. These mouth guards may be made of rubber, polyvinyl chloride, or polyvinyl acetate copolymer and are typically available in small, medium, and large sizes. These stock mouth guards are not in any way molded or "fit" to the persons wearing them and, as a result, can be loose and uncomfortable for the user. Often the mouth must be closed in order to hold them in place, and, not surprisingly, many athletes find them bulky and uncomfortable. In addition, these mouth guards can interfere with speech and breathing, which is a further strong disincentive for athletes to wear these mouth guards. The one benefit to these mouth guards is that they are inexpensive.

Mouth-formed mouth guards are fitted by the user. They are molded to fit the individual wearer either by the use of a moldable inner liner typically of plasticized acrylic gel or silicone rubber, or the use of a moldable thermoplastic that softens when immersed in boiling water and sets when cooled. The thermoplastic mouth guard is also known as the "boil-and-bite" mouth guard. However, repeated biting during participation in athletic events or gnawing due to nervousness before or during an athletic event can cause the material to spread resulting in a loose fit. In addition, aging and/or continual exposure to oral fluids may cause the plasticizers to leach out causing the liner to become hard.

Custom-made mouth guards are considered to be the best of the conventional mouth guards as far as fit, shape retention and comfort are concerned, but they are also the most expensive. This type of mouth guard tends to not have the bulk of the other two types and may stay in position better. Custom mouth guards are typically composed of a thermoplastic polymer, of which the most popular type is ethylene/vinyl acetate copolymer, although acrylic resin, polyurethane, and various rubber materials are also used. Custom-made mouth guards are fabricated by molding over a cast of a person's dentition, and most often this process is done by a dentist or in a dental laboratory. There are usually four steps required in the making of a custom-fit mouth guard: 1) making an impression of the maxillary arch; 2) pouring a cast; 3) forming the thermoplastic material on the cast; and 4) finishing the protector.

The mouth guards described above are typically U-shaped to match the general shape of the upper dental arch and have upward inner lingual and outer labial walls extending there from. Bi-maxillary mouth guards are also available which have protection for both dental arches and hold the mouth in a pre-determined position to allow for maximum breathing capability.

Since 1950 the American Dental Association (ADA) has been active in promoting the use of mouth protectors. In addition to preventing injuries to the teeth, gums, and facial area, a properly fitted mouth guard is believed to be responsible for reducing the number of concussions and neck injuries suffered by athletes. One study by the ADA using a cadaver showed that a mouth protector reduced the amplitude of the inter-cranial pressure wave and decreased the amount of bone deformation by as much as 50%.

Recent improvements in mouth guard performance relate to improved energy absorption. For example, U.S. Pat. No. 5,339,832, to Kittelsen et al., is directed to a thermoplastic mouth guard with an integral shock absorbing framework. The composite mouth guard of Kittelsen et al. comprises a U-shaped mouth guard portion made of a softenable thermoplastic and a shock absorbing and attenuating low compression elastomer framework embedded in the U-shaped mouth guard portion. The shock-absorbing insert portion of the mouth guard attenuates and dissipates shock forces exerted on the mouth guard during athletic activity.

However, even with the improvements described by Kittelsen et al., the mouth guard described is still of the "boil-and-bite" type and requires that the user have access to facilities which permit boiling of the mouth guard in order to form it to the user's mouth.

As will become apparent from the following description, the present invention is a novel, cold formable mouth guard that allows the user to fit the mouth piece by depressing cilia that extend upwardly in the canal where the teeth are to be placed. This arrangement allows for a snug fit every time with out the hassles of boiling and compression fitting the boiled mouthpiece. In other words, the cilia allow the mouth guard to conform to the shape of a mouth and provide excellent energy absorption and dissipation when subjected to force such as that experienced during athletic activity, without the requirement for complicated forming techniques, such as molding an inner liner or requiring a "boil-and-bite" procedure.

In addition to the problems with the prior art described above, another problem that often arises is the stale taste of a mouth piece that is used over and over again. Although the mouth guards are usually washed between games no degree of washing fully gets rid of the bacteria that grow on these mouth pieces. The growth of bacteria can make the mouth guard taste stale and/or unpleasant. This unpleasant taste can be distracting to a player while on the field. Therefore, what is needed is a mouth guard that can be taken out of the package and used immediately without using hot water to form the mouth guard and a mouth guard that provides flavor when placed into the user's mouth taking away the often stale taste left on the mouth guard between games.

The present invention addresses the shortcomings of the mouth guards available on the market today as well as providing additional benefits.

SUMMARY OF THE INVENTION

The present invention is directed to a mouth guard for protecting the teeth of the user that can be tightly fitted into the mouth of the user without using any forming techniques to form the mouthpiece to the user's teeth. More particularly, a mouth guard that uses a multiplicity of extensions in the form of cilia to tightly form around the mouth guard of the user. The present invention is also directed to a mouth guard that is flavored.

The mouth guard of the present invention comprises a U-shaped structure having an inner wall and outer wall. The inner and outer walls of the mouth guard are connected to each other by a base forming a channel between the inner and outer walls. The channel formed is wide enough to fit the user's teeth but not too wide as to make it uncomfortable in a user's mouth.

In an alternative embodiment of the invention the mouth guard comprises a first U-shaped structure having an inner wall and outer wall connected to each other by a base forming a channel between the inner and outer walls designed for the upper teeth of a user and a second U-shaped structure having an inner wall and outer wall connected to each other by a base forming a channel between the inner and outer walls designed for the lower teeth of a user. The first and second U-shaped structures are attached to each other by the underside of each of the bases whereby permitting the user to remove the mouth guard as a single unit. This structure allows the user to protect the lower and upper teeth at the same time while the previous embodiment above protects against the upper and lower teeth smashing together.

Dispersed in the channel of the U-shaped structures of the mouth guard is a plurality of flexible extensions, referred to as cilia, that project away from the base within the channel of the mouth guard. In other words, the cilia will project downwardly form the base of the U-shaped structure designed to protect the upper teeth of the user and upwardly from the base of the U-shaped structure designed to protect the lower portion of the user's teeth. Simply stated the cilia are always projecting towards the teeth of the user.

The cilia are constructed of an elastomeric material that is formable to the dentition of a wearer at room temperature. In other wards, when the mouth guard is placed into the mouth of the user, the cilia are either depressed or moved to the side of the teeth so as to allow the mouth guard to fit tightly into the user's mouth.

The mouth guard of the present invention may also further comprise a flavoring material. The flavoring material may be impregnated directly within the material from which the mouth guard is constructed in the form of an evenly dispersed emulsion or as flavor crystals that are dispersed throughout the mouth guard. These flavor crystals would release flavor into the mouth of the user as they dissolve. The flavor agent whether as an emulsion or in the form of crystals can also provide a fragrance to the mouth guard. The flavoring agent can mask the often stale smell and taste of a mouth guard that has been used and stored several times.

In an alternative embodiment of the invention, the mouth guard may have at least one pocket formed in the inner walls, outer walls or base of the mouth guard. The pocket is sized and shaped to receive a flavoring agent capsule. The flavoring agent capsule is constructed so as to release the flavoring agent once pressure is applied to it. The pocket is connected to at least one duct that extends from the pocket of the mouth guard to an inner surface of the mouth guard. This duct defines a passageway for the flavoring agent to flow from the pocket containing the flavoring agent to the mouth of the user when sufficient force is placed on the flavoring agent capsule by the user.

In yet another embodiment of the invention, the mouth guard may be fitted with a tether that provides for a quick way to remove said mouth guard from a user's mouth.

Since mouth guards are used over and over again another embodiment of the present invention is constructed to have an opening formed in the pockets that will allow the user a passage way to replace the flavoring agent capsule once it is used or if another flavor is desired.

The flavoring agent may contain a sweet flavor, mint flavor, vanilla flavor, bubblegum flavor, sour flavor, cola flavor or in the alternative an electrolyte or caffeine based solution that can be released during a sports competition when the player has lost electrolytes because of perspiration or if the player is feeling fatigued. The present invention is shown in the figures and described more fully in the detailed description of the figures below.

DETAILED DESCRIPTION OF THE INVENTION

The invention described herein is directed to a mouth guard for protecting the teeth of the user that can be tightly fitted into the mouth of the user without using any forming techniques to form the mouthpiece to the user's teeth. There are two main embodiments of the invention that are depicted in FIGS. 1-5.

Figure 1:
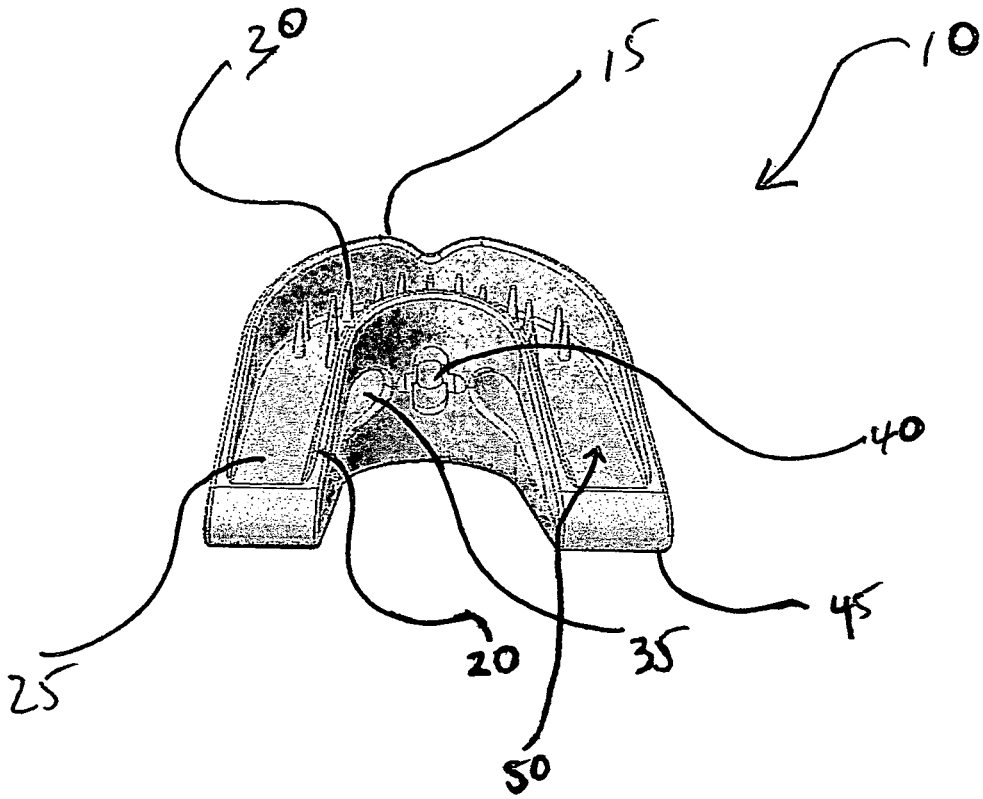
FIG. 1: Posterior View of Single Mouth guard.
(10) single mouth guard
(15) inner wall
(20) outer wall
(25) base
(30) cilia
(35) flavor passage
(40) flavor pocket
(45) underside of base

As seen in FIG. 1, which is a posterior view along the longitudinal plane of the single mouth guard, the single mouth guard (10) has an outer wall (15) and an outer wall (20) that is connected together by a base (25). The outer wall (15) is high enough to protect the front teeth of the user, yet low enough not to irritate the gums of the user. The inner wall (20) may be lower than the outer wall (15) so that the user's tongue can comfortably rest behind the inner wall (20). The outer and inner walls can be sloped so as to be higher in towards the front of the teeth and slope downward towards the back of the mouth guard.

Dispersed throughout the channel (50) formed by the inner wall, outer wall and base are filamentous extensions that are anchored to the base and extend away from the base. These filamentous extensions are referred to as cilia (30) for the purpose of this patent. The cilia (30) can be spaced evenly throughout or bunched in particular areas as per the design of each mouth guard. The cilia (30) provide a source of resistance between the teeth and inner wall (15), base (25) and outer wall (20) to assure a snug fit. Once the mouth guard is placed on the teeth of the user, the cilia (30) are depressed and deflected so as to tightly fit around the user's teeth. As mentioned above, a tight fit is necessary for proper protection of the user's teeth. This proper fitting is accomplished without the use of any molding or hot water techniques.

Once the upper or lower teeth have the mouth guard in place the underside of the mouth guard (45) protects the teeth from grinding and smashing together should the user be struck in the mouth area. The portion of the teeth having the mouth guard in place will also be protected from trauma and or breakage.

Also shown in FIG. 1, at least one flavor pocket (40) is formed in the inner wall of the mouth guard. The flavor pocket (40) is sized and shaped so as to accommodate a flavor containing capsule (not shown). The flavor containing capsule contains either a gel or fluid within and has a thin skin so that it easily bursts upon pressure being placed thereupon. Once the flavor capsule is inserted into the mouth guard and the mouth guard is in place, applying pressure either through the use of the tongue or by biting down flavor is released. The flavor can enter the oral cavity of the user through flavor passages (35).

The flavor passages (35) can be as simple as a opening in the inner wall (15) of the mouth guard or can include accurate channels that extend between the flavor pocket and the inner surface of the inner wall so as to allow the flavor to flow from the flavor pocket to the oral cavity once the flavor capsule is ruptured.

The flavor passages can be slightly accurate or arched so as to form a vertical incline which will regulate the flow of gel flowing from the flavor capsule 40 contained in the flavor pocket (40) through the arched channels and into the mouth of the user. Having this incline the user is able to take advantage of the flavor through an extended period of time over the course of a game and/or practice, rather than having the flavor from the capsules flow into his mouth quite readily and the taste be experienced only for a short time.

The flavor pocket may be fitted with an upper opening or slit in the rubberized material of the mouth guard which makes up the mouthpiece. The slit may be a flexible slit and would allow the user to slide the flavor gel capsule through the slit and into the flavor pocket. Once in place, the slit would then return back to its closed position, and therefore, would prevent the capsule from sliding out of the pocket inadvertently. This is important so as to prevent a choking hazard should the flavor capsule become dislodged due to blunt trauma.

Figure 2:
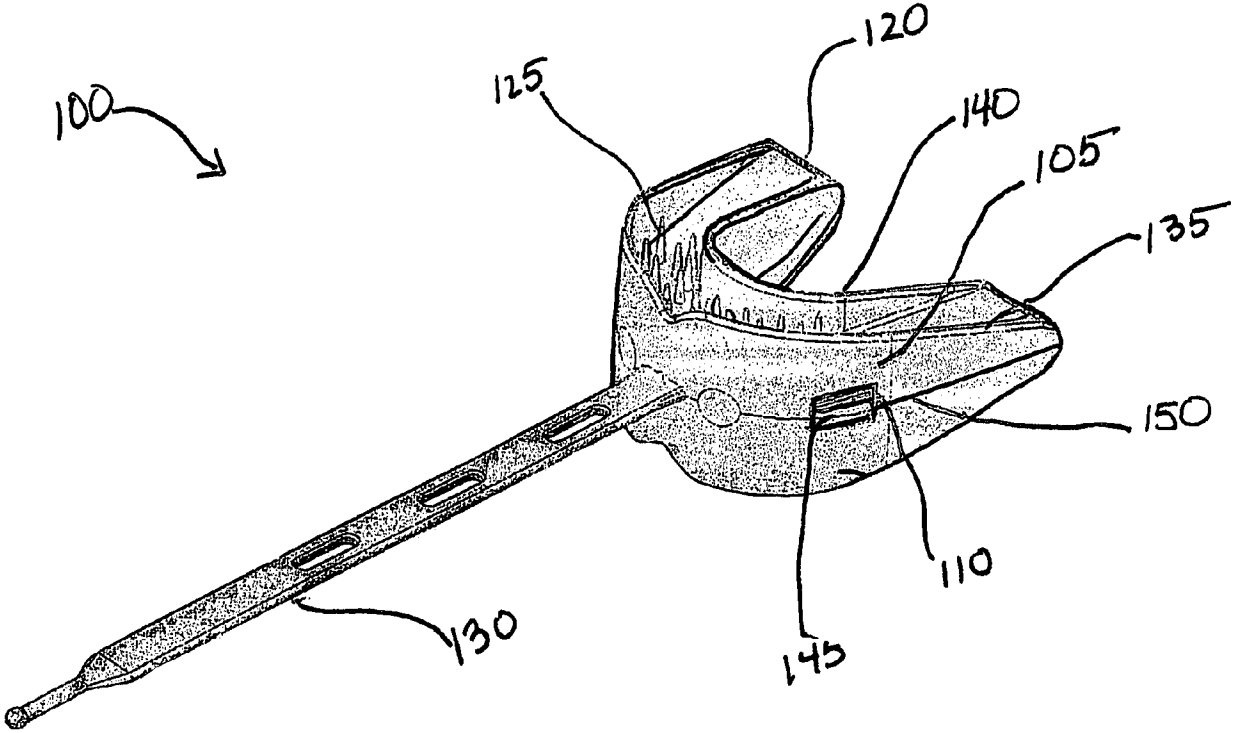
FIG. 2: Frontal View of Upper and Lower Mouth guard.
(100) Upper and Lower mouth guard
(105) upper portion of U-shaped mouth guard
(110) lower portion of u-shaped mouth guard
(115) connecting line
(120) base
(125) cilia
(130) tether
(135) outer wall
(140) inner wall
(145) flavor pocket
(150) flavor slit

FIG. 2 of the present invention shows a frontal view of a mouth guard with both an upper and lower portion (100). The mouth guard shown in this embodiment has an upper U-shaped mouth guard (105) and a lower U-shaped mouth guard (110) connected together at a connecting line (115) to make a single unit. The upper U-shaped mouth guard comprises an inner wall (140) and an outer wall (135) connected together by a base (135) to form a channel.

The base (120) of the upper U-shaped mouth guard, as described above in the embodiment shown in FIG. 1, has filamentous extensions that are anchored to the base (120) called cilia (125). These cilia (125) extend away from the base (120) and can be spaced evenly throughout the channel or they can be bunched in particular areas as per the design of each mouth guard. As in FIG. 1 these cilia (125) assure that a snug fit can be obtained once the mouth guard is placed on the teeth of the user. The snug fit is achieved by displacing and depressing the cilia (120) so as to wedge the cilia between the teeth and the outer and inner walls as well as the base of the channel. This proper fitting is accomplished without the use of any molding or hot water techniques.

The same structures that are described above for the upper U-shaped mouth guard (105) are found in the lower U-shaped mouth guard (110) but are not shown in FIG. 2. Once the upper and lower U-shaped portions are in place the teeth are protected from grinding and smashing together as well as from direct trauma and or breakage should the user be struck in the mouth area. The mouth guard can be removed as a single unit by pulled on the attaché tether (130).

As in the embodiment shown is FIG. 1, the embodiment shown in FIG. 2 has a flavor pocket located in the inner wall, the outer wall or both. One flavor pocket (145) is shown in the outer wall of the mouth guard. Additional flavor pockets can be located throughout the mouth guard so as to provide various flavoring experiences. The flavor pocket may be fitted with an upper opening or slit (150) in the rubberized material of the mouth guard which makes up the mouthpiece. The slit (150) may be a flexible slit and would allow the user to slide the flavor capsule through the slit (150) and into the flavor pocket (145). Once in place, the slit (150) would then return back to its closed position, and therefore, would prevent the capsule 42 from sliding out of the pocket inadvertently. This is important so as to prevent a choking hazard should the flavor capsule become dislodged due to blunt trauma.

The mouth guard may also be fitted with flavor passages (not shown) that can be as simple as a opening in the inner wall (15) of the mouth guard or can include accurate channels that extend between the flavor pocket and the inner surface of the inner wall so as to allow the flavor to flow from the flavor pocket to the oral cavity once the flavor capsule is ruptured.

In an alternative embodiment of the invention, the flavoring can also be impregnated into the mouth guard material so as to provide all of the flavor or in addition of the flavor capsules. The mouth guard may also have flavor crystals lodged within the mouth guard so as to release flavor over time. Again this can be in addition to the flavor provided by the flavor capsules or the sole source of flavoring for the mouth guard.

Figure 3:
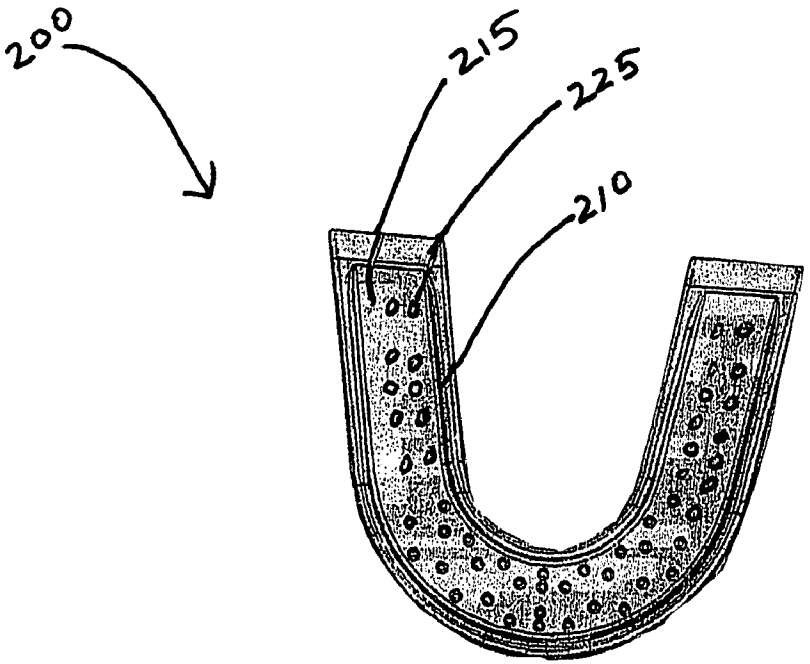
FIG. 3: Top View of Mouth guard.
(200) Top view of mouth guard
(205) outer wall
(210) inner wall
(215) base
(220) cilia

FIG. 3 shows a top view of the upper or lower portion of the mouth guard. The U-shaped portion of the mouth guard (200) has an outer wall (205) an inner wall (210) that is connected by a base (215). As shown in this view the cilia (220) are dispersed throughout the channel formed by the inner and outer walls and are arranged in a random pattern.

Figure 4:
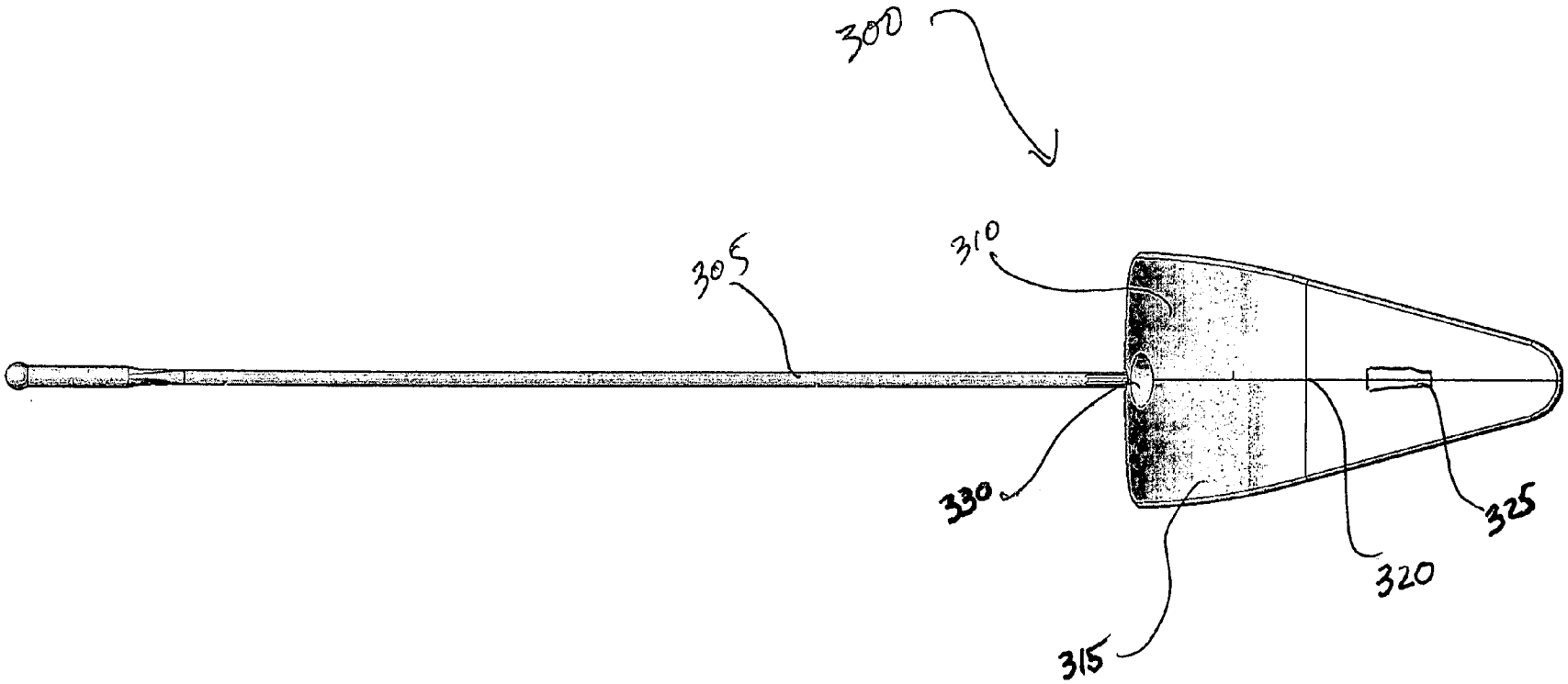
FIG. 4: Side View of Upper and Lower Mouth guard.
(300) upper and lower mouth guard
(305) tether
(310) upper portion
(315) lower portion
(320) connecting line
(325) flavor pocket
(330) flavor and air passage

FIG. 4 shows a longitudinal side view (300) with the tether (305) attached. The lower U-shaped portion (315) is connected to the upper-U-shaped portion (310) at the connecting line (320). A flavor pocket (325) is shown along the connecting line (320) but additional pockets can be located throughout. Located in the front of the mouthpiece is shown a flavor passage (300) that may also be used as an air passage. As with the flavoring pockets additional passages can be located throughout the mouth guard although only one is shown in this view.

Figure 5:
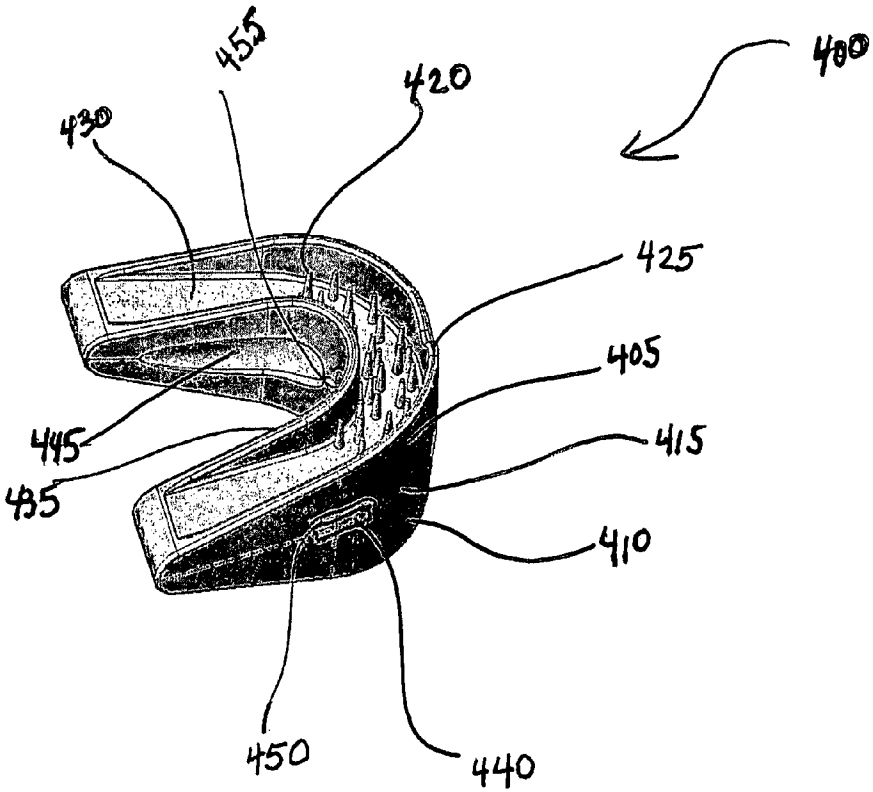
FIG. 5: Top/Side View of Upper and Lower Mouth guard
(400) upper and lower mouth guard
(405) upper portion
(410) lower portion
(415) connecting line
(420) cilia
(425) outer wall
(430) base
(435) inner wall
(440) flavor pocket
(445) flavor passage
(450) flavor slit

FIG. 5 shows a top/side view of the upper and lower mouthpiece (400). In this figure the upper portion (405) and the lower portion (410) of the mouth guard are connected at the connecting line (415) to form a single unit. As with the figures above, the upper portion is shown having an outer wall (425), an inner wall (435), connected together by a base (430). The base is shown having a plurality of upwardly projecting cilia dispersed throughout the channel. These structures are shown in the figures above and operate accordingly. This figure shows a flavor pocket (440) having a slit (450) located ion the outer wall (425). The slit (450) is in communication with the pocket so that a flavor capsule can be placed within the flavor pocket (440). It also shows a flavor pocket (455) located in the inner wall (435) that can also contain a flavor capsule.

In addition to the features shown above, all of which are shown in other views, this figure shows a flavor passage (445) located on the inside portion of the mouthpiece. The flavor passage (445) is in communication with the flavor pockets so that the flavor released from the flavor capsule can reach the oral cavity of the user. The mouthpiece provides the protections discussed above and the benefits of a snug fit and flavoring when desired.

The mouth guards of the present invention may be molded out of resilient materials such as rubber, plastic, polymers, as well as other man-made materials. The cilia of the mouthguards must be mandible so that they can be depressed, and maneuvered so as to allow the teeth to fit into the channel with a tight fit. The molding and/or casting of the mouthguards described herein may be made using molding techniques that are well know in the art. The material used may be impregnated with flavor or antibacterial agents that keep the mouth guard smelling and tasting fresh while preventing bacterial growth in between uses. The techniques used to impregnate additives during the molding process are also well know in the art and can be used to make the mouthguards of the present invention.

While the invention has been illustrated and described with respect to specific illustrative embodiments and modes of practice, it will be apparent to those skilled in the art that various modifications and improvements may be made without departing from the scope and spirit of the invention. Accordingly, the invention is not to be limited by the illustrative embodiments and modes of practice.

What is claimed is

1. A mouth guard comprising:

a first U-shaped structure having an inner wall and outer wall, said inner and outer walls connected to each other by a base forming a channel between said inner and outer walls designed for the upper teeth of a user;

a second U-shaped structure having an inner wall and outer wall, said inner and outer walls connected to each other by a base forming a channel between said inner and outer walls designed for the lower teeth of a user;

said first U-shaped structure being connected to said second U-shaped structure so that the channel of the first U-shaped structure fits on the user's upper teeth while the second U-shaped structure fits on the user's lower teeth and the mouth guard is removed from the user's mouth as a single unit;

a plurality of flexible extensions originating from said base and projecting away from said base within said channel of said first U-shaped structure and said second U-shaped structure whereby at least a portion of said plurality of flexible extensions are formable to the dentition of the user at room temperature; and a flavored emulsion substantially evenly dispersed throughout the material form which said mouth guard is constructed so as to provide a fragrance and/or flavoring to said mouth guard.

2. The mouth guard according to claim 1 wherein said plurality of flexible extensions comprises at least one elastomeric material.

3. The mouth guard according to claim 1 further comprising at least one pocket formed in at least one of said inner walls, outer walls or said base, said pocket sized and shaped to receive a flavoring agent capsule; and at least one duct extending from said pocket to an inner surface of said mouth guard whereby defining a passageway for said flavoring agent to flow from said pocket containing said flavoring agent to the mouth of the user when sufficient force is placed on said flavoring agent capsule by the user.

4. The mouth guard according to claim 3 further comprising an opening formed in said pocket, whereby providing a passageway for said flavoring agent capsule to be replaced.

5. The mouth guard according to claim 1 further comprising a tether attached to said mouth guard whereby providing for a quick way to remove said mouth guard from a user's mouth.

6. The mouth guard according to claim 1 wherein the flavoring crystals have a flavoring selected from the group consisting of mint flavoring, sweet flavoring, vanilla flavoring, bubblegum flavoring, sour flavoring, electrolyte containing flavoring, caffeine containing flavoring and cola flavoring.

7. The mouth guard according to claim 1 further comprising antibacterial agents impregnated in the material form which said mouth guard is constructed so as to prevent bacterial growth on said surface of said mouth guard between uses.

8. A mouth guard comprising:

a U-shaped structure having an inner wall and outer wall, said inner and outer walls connected to each other by a base forming a channel between said inner and outer walls;

a plurality of flexible extensions originating only from said base and projecting away from said base within said channel whereby at least a portion of said plurality of flexible extensions are formable to the dentition of a wearer at room temperature;

a flavored emulsion dispersed throughout the material from which said mouth guard is constructed; and antibacterial agents impregnated in the material form which said mouth guard is constructed so as to prevent bacterial growth on said surface of said mouth guard between uses.

9. The mouth guard according to claim 8 wherein said flavored emulsion is substantially evenly dispersed throughout the material form which said mouth guard is constructed so as to provide a fragrance and/or flavoring to said mouth guard.

* * * * *